US005172105A

United States Patent [19]

Katakura et al.

[11] Patent Number: 5,172,105

[45] Date of Patent: Dec. 15, 1992

[54] DISPLAY APPARATUS

[75] Inventors: Kazunori Katakura, Atsugi; Akira Tsuboyama, Sagamihara; Hiroshi Inoue, Yokohama, all of Japan

[73] Assignee: Canon Kabushiki Kaisha, Tokyo, Japan

[21] Appl. No.: 629,572

[22] Filed: Dec. 18, 1990

[30] Foreign Application Priority Data

Dec. 20, 1989 [JP] Japan ..... 1-332205

[51] Int. Cl.[5] ..... G09G 3/36

[52] U.S. Cl. ..... 340/784; 340/805; 340/811

[58] Field of Search ..... 340/811, 784, 805; 359/54, 56, 57; 358/236, 241

[56] References Cited

U.S. PATENT DOCUMENTS

| | | | |
|---|---|---|---|
| 4,395,709 | 7/1983 | Nagae et al. | 340/784 |
| 4,561,726 | 12/1985 | Goodby et al. | 359/75 |
| 4,589,996 | 5/1986 | Inoue et al. | 252/299.65 |
| 4,592,858 | 6/1986 | Higuchi et al. | 252/299.66 |
| 4,596,667 | 6/1986 | Inukai et al. | 252/299.65 |
| 4,613,209 | 9/1986 | Goodby et al. | 359/104 |
| 4,614,609 | 9/1986 | Inoue et al. | 252/299.66 |
| 4,622,165 | 11/1986 | Kano et al. | 252/299.65 |
| 4,630,122 | 12/1986 | Morokawa | 340/784 |
| 4,679,043 | 7/1987 | Morokawa | 340/784 |
| 4,816,816 | 3/1989 | Usui | 340/784 |
| 4,816,819 | 3/1989 | Enari et al. | 341/811 |
| 4,845,473 | 7/1989 | Matsukashi et al. | 340/784 |
| 4,922,241 | 5/1990 | Inoue et al. | 340/784 |
| 4,930,875 | 6/1990 | Inoue et al. | 359/56 |
| 4,958,912 | 9/1980 | Inaba et al. | 358/56 |

FOREIGN PATENT DOCUMENTS 316774 5/1989 European Pat. Off. .

OTHER PUBLICATIONS

Journal de Physique Lettres, TOME 35, pp. L-69 to L-72 (May 1974), "Ferroelectric Liquid Crystals."

Applied Physics Letters, vol. 36, No. 11, pp. 899-901, Mar. 1980, "Submicrosecond by Stable Electro-Optic Switching and Liquid Crystals."

*Primary Examiner*—Jeffery A. Brier

*Assistant Examiner*—Jick Chin

*Attorney, Agent, or Firm*—Fitzpatrick, Cella, Harper & Scinto

[57] ABSTRACT

A display apparatus disposes a ferroelectric liquid crystal between a group of scanning electrodes and a group of data electrodes constituting an electrode matrix, and provides a driver that applies a scanning signal to the scanning electrodes and applies data signals to the data electrodes in synchronism with the scanning signal. The driver is controlled as to divide the scanning electrodes into a plurality of blocks each comprising a plurality of scanning electrodes and select the scanning electrodes with skipping of at least one scanning electrode apart so that starting scanning electrodes in neighboring blocks from which the skipping-selection of scanning electrodes is started in each block of the scanning electrodes have mutually different positional ranks respectively in the neighboring blocks, whereby flickering caused by either scanning drive or by repetition of black and white signals is effectively suppressed while the observability of a motion picture is retained.

19 Claims, 8 Drawing Sheets

DISPLAY APPARATUS

FIELD OF THE INVENTION AND RELATED ART

The present invention relates to a display apparatus or a device unit suitably loaded on a recording apparatus, particularly such an apparatus or device unit using a ferroelectric liquid crystal.

Hitherto, there has been a well-known type of liquid crystal display device, wherein a liquid crystal material is disposed between a group of scanning electrodes and a group of data electrodes constituting an electrode matrix so as to form a large number of pixels for display image data. Such a display device has been driven by a multiplexing drive scheme wherein an address signal is sequentially, periodically and selectively applied to the scanning electrodes and prescribed data signals are applied in parallel and selectively to the data electrodes in synchronism with the address signal.

The scanning electrodes may be sequentially selected according to a non-interlaced scanning scheme wherein the scanning electrodes are selected sequentially from one side to the other, a so-called two-interlaced scanning scheme wherein the scanning electrodes are selected with skipping of one line apart (i.e., every other line), or a so-called N-interlaced scanning scheme proposed by Mihara et al in European published Patent Specification EP-A-316774 wherein the scanning electrodes are selected with skipping of N-lines apart (N=2, 3, 4, . . . ). Particularly, in a display apparatus requiring a relatively long selecting term for one scanning electrode, a $2^n$-interlaced scanning scheme (n is an integer of 1, 2, 3, . . . ) has been frequently used so as to suppress flickering due to scanning drive at a low field frequency and for convenience of a scanning system.

On the other hand, the voltage waveform i.e , voltage change with time, applied to a pixel (i.e., between the electrodes) varies depending on whether the display signal is a black-displaying signal or a white-displaying signal so that the optical response of the pixel varies. When the scanning electrode covered is at the time of selection, the pixel is switched into a black or a white state, but when the scanning electrode is at the time of non-selection, the pixel changes its brightness level depending on the waveform of the data signal while retaining the black or white state. When a data electrode is supplied with a black signal and a white signal alternately, the pixels on the data electrode change their bright levels according to a cycle of the alternation between the black and white signals continually throughout the period of non-selection. If the cycle of alternation is lowered to a certain level or below determined by the brightness levels according to the black and white signals, a flickering phenomenon occurs.

In a display apparatus, a repeating image for a cycle of $2^n$ (n=an integer of 1, 2, 3, . . . ) has been frequently used. In this instance, if the above-mentioned conventional $2^n$-interlaced scanning scheme is applied, the white and black signals are cyclically repeated to cause flickering in some cases.

On the other hand, if the degree of interlacing is enhanced to increase the field frequency so as to suppress the flickering, the observability of a moving image (motion picture) can be lowered in some cases.

SUMMARY OF THE INVENTION

Accordingly, an object of the present invention is to provide a display apparatus which has accomplished both suppression of flickering and improvement in observability of moving images, particularly a ferroelectric liquid crystal display apparatus having accomplished such improvements.

Another object of the present invention is to provide a recording apparatus including a device unit which per se has a similar structure as the above-described display apparatus.

According to a principal aspect of the present invention, there is provided a display apparatus, comprising:

(a) an electrode matrix comprising a group of scanning electrodes and a group of data electrodes;

(b) drive means including a first means for applying a scanning signal to the scanning electrodes and a second means for applying data signals to the data electrodes in synchronism with the scanning signal; and (c) control means for controlling the drive means so as to divide the scanning electrodes into a plurality of blocks each comprising a plurality of scanning electrodes and select the scanning electrodes with skipping of at least one scanning electrode apart so that starting scanning electrodes in neighboring blocks from which the skipping-selection of scanning electrodes is started in each block of the scanning electrodes have mutually different positional ranks respectively in the neighboring blocks.

According to another aspect of the present invention, there is provided a recording apparatus comprising a device unit similar in structure as the display apparatus described above; and also image data control means for supplying data to the control means corresponding to given image data; a photosensitive member; and a developing device.

According to the present invention, as different from a conventional interlaced scanning scheme wherein scanning with a skipping of a definite number of scanning electrodes is uniformly performed throughout one vertical scanning, the picture area is divided into a plurality of picture sections, and the positions of starting scanning electrodes where the scanning is started in the respective picture sections are made different so that the lowering of frequency of change between black and white signals is suppressed to alleviate the flickering while maintaining the observability of motion pictures, thus improving the image quality.

DESCRIPTION OF THE PREFERRED EMBODIMENTS

First of all, an outline of the display apparatus according to the present invention is explained with reference to an embodiment thereof which is a liquid crystal display apparatus using an electrode matrix comprising 512 lines of scanning electrodes and 1280 lines of data electrodes, in comparison with a prior art embodiment.

Figure 1:
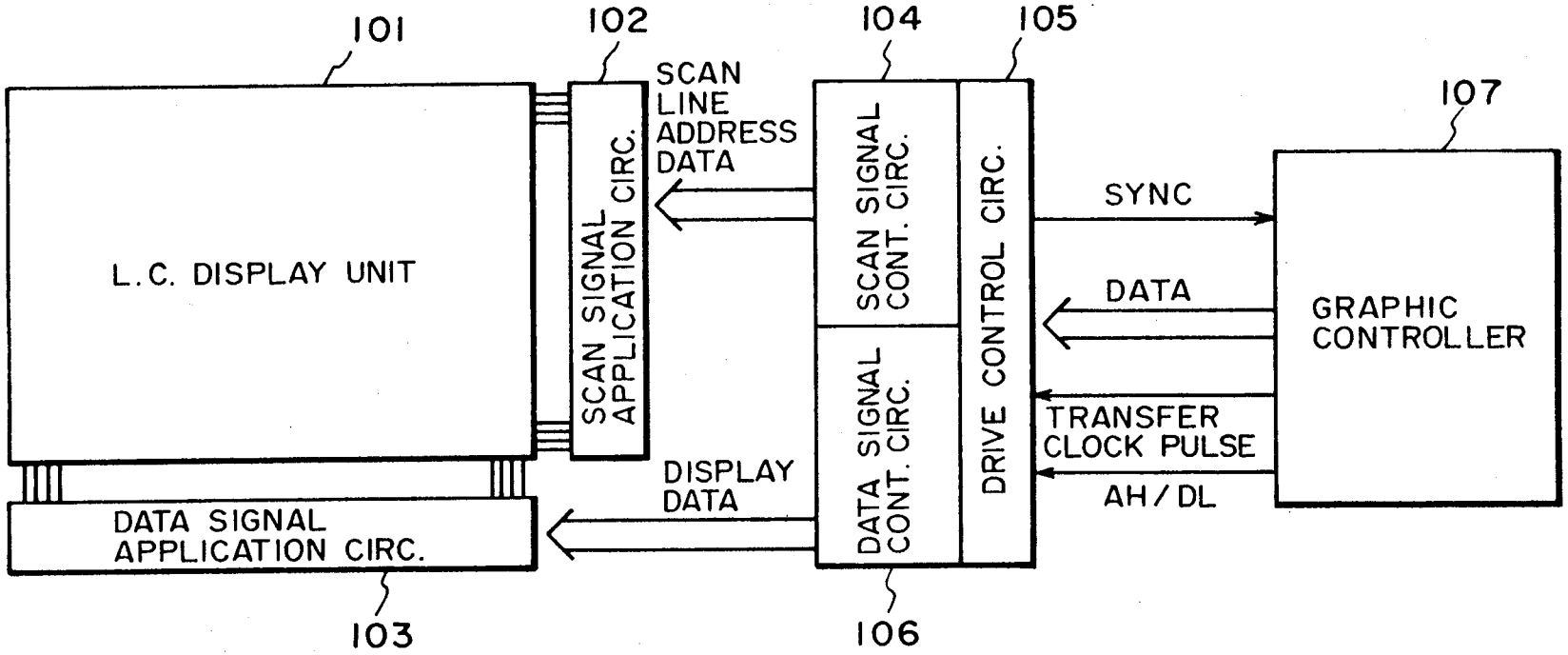
FIG. 1 is a block diagram of a display apparatus or system according to the present invention.

FIG. 1 shows an embodiment of the display apparatus according to the present invention. Referring to FIG. 1, the display apparatus includes a liquid crystal display unit (panel) 101, a scanning signal application circuit 102, a data signal application circuit 103, a scanning signal control circuit 104, a drive control circuit 105, a data signal control circuit 106 and a graphic controller 107.

Data supplied from the graphic controller 107 through the drive control circuit 105 enter the scanning signal control circuit 104 and the data signal control circuit 106 where they are converted into address data and display data, respectively. According to the address data, the scanning signal application circuit 102 generates scanning signals which are supplied to the scanning electrodes in the liquid crystal display unit 101. Further, according to the display data the data signal application circuit 103 generates data signals, which are supplied to the data electrodes in the liquid crystal display unit 101.

Figure 2:
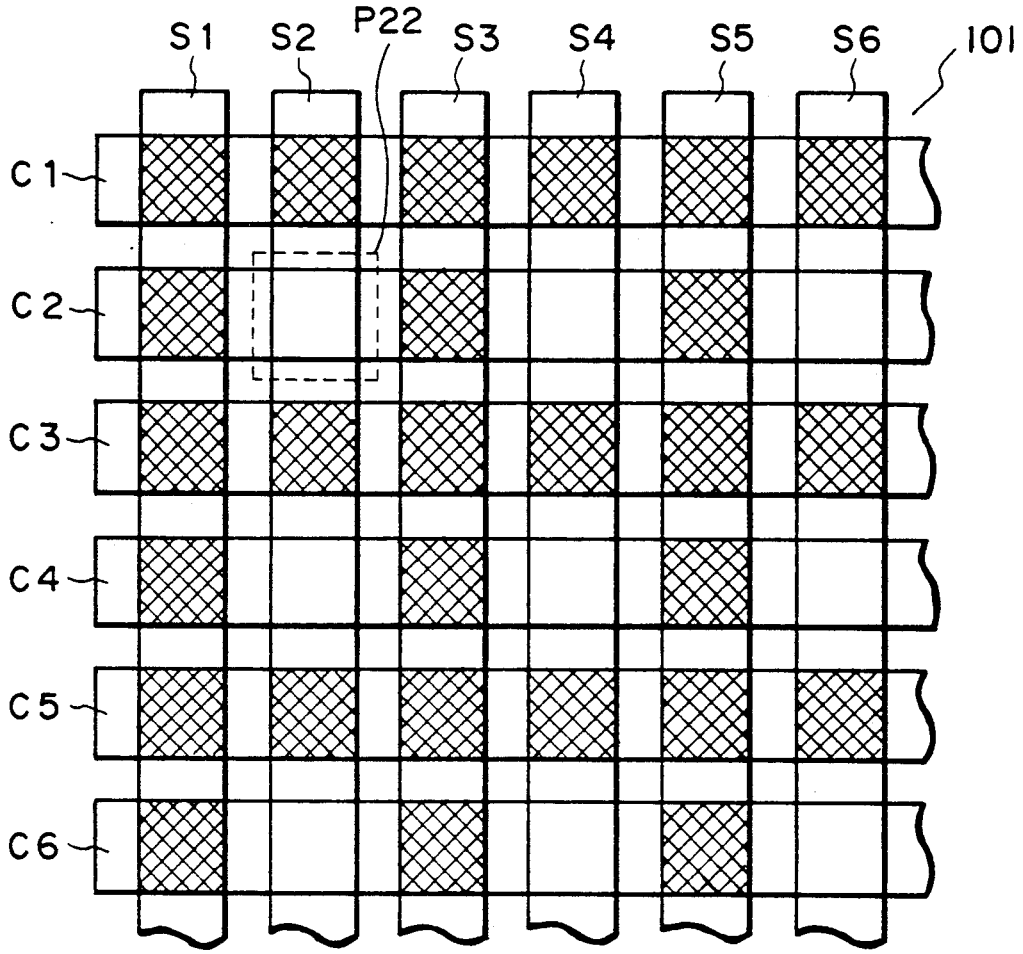
FIG. 2 is a partial schematic plan view of a liquid crystal display unit (picture area) used in the present invention.
Figure 3:
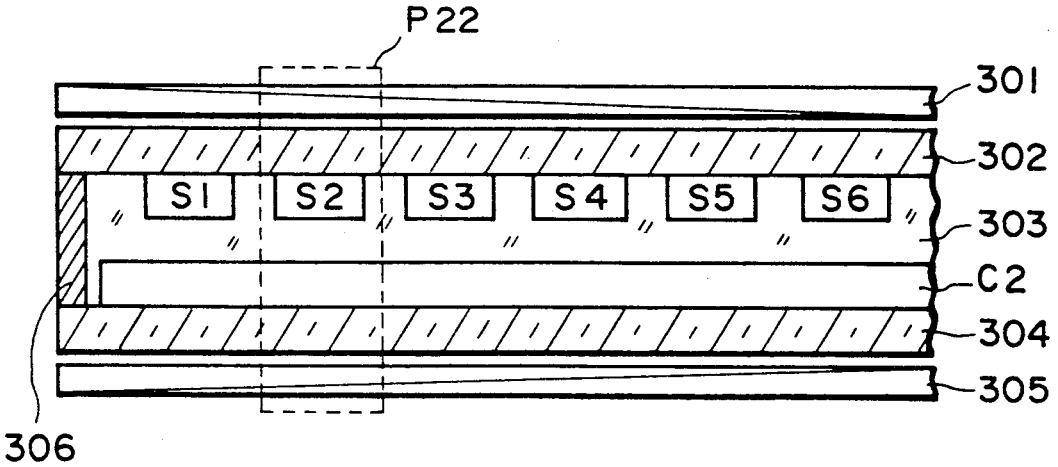
FIG. 3 is a schematic sectional view thereof.

FIG. 2 is an enlarged partial view of the liquid crystal display unit 101 which includes scanning electrodes C-C6 . . . and data electrodes S1-S6 . . . disposed so as to form an electrode matrix and form pixels each constituting a display unit, including, e.g., a pixel P22 formed at the intersection of a scanning electrode C2 and a data electrode S2. FIG. 3 is a partial sectional view of the display unit taken along the scanning electrode C2 in FIG. 2. Referring to FIG. 3, the liquid crystal display unit 101 includes glass substrates 302 and 304 and a ferroelectric liquid crystal 303 disposed between the substrates 302 and 304 and in a cell structure forming a cell gap defined by a spacer 306. Further, an analyzer 301 and a polarizer 305 are disposed in cross nicols so as to sandwich the cell structure.

More specifically, the cell structure shown in FIGS. 2 and 3 comprises a pair of substrates 302 and 304 made of glass plates or plastic plates which are held with a predetermined gap with spacers 306 and sealed with an adhesive to form a cell structure filled with a liquid crystal. On the substrate 304 is further formed an electrode group (e.g., an electrode group for applying scanning voltages of a matrix electrode structure) comprising a plurality of transparent electrodes C1-C6 . . . in a predetermined pattern, e.g., of a stripe pattern. On the substrate 302 is formed another electrode group (e.g., an electrode group for applying data voltages of the matrix electrode structure) comprising a plurality of transparent electrodes S1-S6 . . . intersecting with the transparent electrodes C1-C6.

In the device, the alignment control films (not shown) may be directly disposed over the transparent electrodes C1-C6 and S1-S6 formed on the substrates 304 and 302, respectively. In another embodiment, on the substrates 304 and 302, insulating films for short circuit prevention (not shown) and alignment control films (not shown) may be disposed, respectively.

Examples of the material constituting the alignment control films may include inorganic insulating materials, such as silicon monoxide, silicon dioxide, aluminum oxide, zirconia, magnesium fluoride, cerium oxide, cerium fluoride, silicon nitride, silicon carbide, and boron nitride; and organic insulating materials, such as polyvinyl alcohol, polyimide, polyamide-imide, polyesterimide, polyparaxylylene, polyester, polycarbonate, polyvinyl acetal, polyvinyl chloride, polyamide, polystyrene, cellulose resin, melamine resin, urea resin and acrylic resin. The above-mentioned alignment (control) film of an insulating material can be also used as an insulating film for short circuit prevention.

The alignment control films of an inorganic insulating material or an organic insulating material may be provided with a uniaxial alignment axis by rubbing the surface of the film after formation thereo in one direction with velvet, cloth or paper to form the uniaxial alignment axis.

Further, the insulating films for short circuit prevention may be formed in a thickness of 200 Å or larger, preferably 500 Å or larger, with an inorganic insulating material, such as $SiO_2$, $TiO_2$, $Al_2O_3$, $Si_3N_4$ and $BaTiO_3$. The film formation may for example be effected by sputtering, ion beam evaporation, or calcination of an organic titanium compound, an organic silane compound, or an organic aluminum compound. The organic titanium compound may for example be an alkyl (methyl, ethyl, propyl, butyl, etc.) titanate compound, and the organic silane compound may be an ordinary silane coupling agent. In case where the thickness of the insulating films for short circuit prevention is below 200 Å, a sufficient short circuit prevention effect cannot be accomplished. On the other hand, if the thickness is above 5000 Å, the effective voltage applied to the liquid crystal layer is decreased substantially, so that the thickness may be set to 5000 Å or less, preferably 2000 Å or less.

The liquid crystal material suitably used in the present invention is a chiral smectic liquid crystal showing ferroelectricity. More specifically, liquid crystals in chiral smectic C phase (SmC*), chiral smectic G phase (SmG*), chiral smectic F phase (SmF*), chiral smectic I phase (SmI*) or chiral smectic H phase (SmH*) may be used.

Details of ferroelectric liquid crystals may be disclosed in, e.g., LE JOURNAL DE PHYSIQUE LETTERS<36 (L-69) 1975, "Ferroelectric Liquid Crystals"; Applied Physics Letters 36 11, 1980, "Submicro Second Bi-stable Electrooptic Switching in Liquid Crystals"; Kotai Butsuri (Solid-State Physics) 16 (141) 1981, "Ekisho (Liquid Crystals)"; U.S. Pat. Nos. 4,561,726; 4,589,996; 4,592,858; 4,596,667; 4,613,209; 4,614,609; 4,622,165, etc. Chiral smectic liquid crystals disclosed in these references can be used in the present invention.

Other specific examples of ferroelectric liquid crystal may include decyloxybenzylidene-p'-amino-2-methylbutylcinnamate (DOBAMBC), hexyloxybenzylidene-p'-amino-2-chloropropylcinnamate (HOBACPC), and 4-O-(2-methyl)butylresorcylidene-4'-octylaniline (MBRA 8).

First Embodiment

As for the liquid crystal display apparatus embodiment shown in FIGS. 1-3, when the selecting term for one scanning electrode is 96 μsec, the frame frequency become 1/(512×96 μsec)=20.3 Hz. In this display apparatus, if the field frequency is 40 Hz or higher, flickering caused by scanning drive is suppressed, so that one picture is designed to be formed by two times of vertical scanning.

Figure 4:
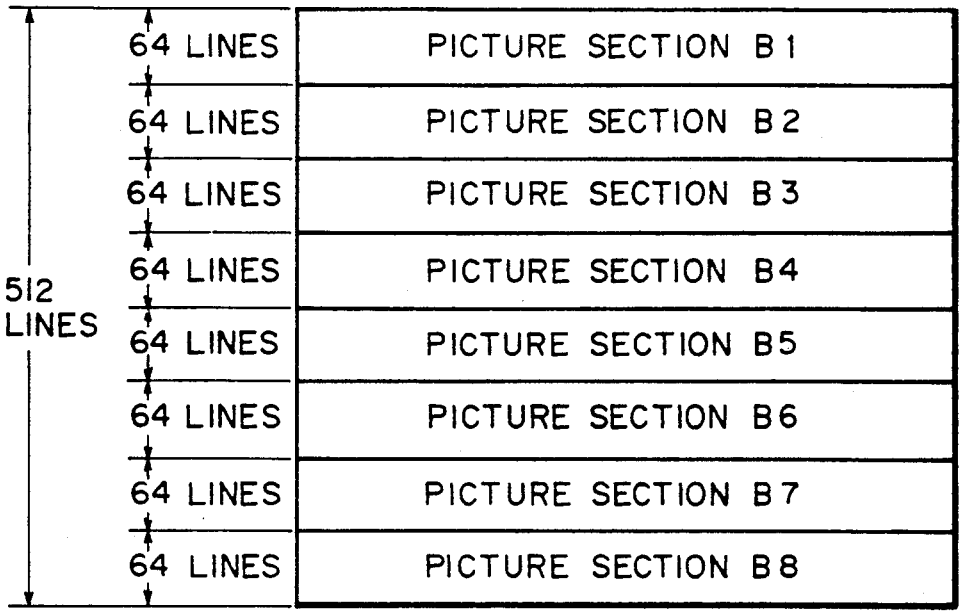
FIG. 4 is a schematic view of a picture area divided into blocks (picture sections).

As shown in FIG. 4, the whole picture area composed of 512 lines (scanning electrodes) is divided into 8 picture sections (hereinafter called "block(s)". B1-B8 each comprising 64 scanning electrodes. In the first block B1, every other scanning electrode is selected from the first scanning electrode as a starting scanning electrode so that the 1st, 3rd, 5th, . . . to 63th scanning electrodes are sequentially selected. In the second block, B2, every other scanning electrode is selected from the second scanning electrode as a starting scanning electrode so that the 2nd, 4th, 6th, . . . 64th scanning electrodes (66th, 68th . . . to 128th scanning electrodes in the entire scanning electrodes) are sequentially selected. Similarly, as for the third block, the 1st (starting), 3rd, 5th . . . to 63rd scanning electrodes are sequentially selected, and as for 4th, 5th, 6th, 7th and 8th blocks, only 2n-th, (2n−1)th, 2n-th, (2n−1)th, 2n-th and 2n-th electrodes (n=1, 2, . . . , 32), respectively are sequentially selected to complete the first vertical scanning. Subsequently, in the first block, every other scanning electrode is selected from the second scanning electrode as a starting scanning electrode so that the 2nd, 4th, . . . to 64th scanning electrodes are sequentially selected. Thereafter, as for 2nd, 3rd, 4th, 5th, 6th, 7th and 8th blocks, only the (2n−1)th, 2n-th, (2n−1)th, 2n-th, (2n−1)th, 2n-th and (2n−1)th scanning electrodes (n=1, 2, 3, . . . 32), respectively, are sequentially selected to complete the second vertical scanning, whereby one entire picture is written.

Figure 5:
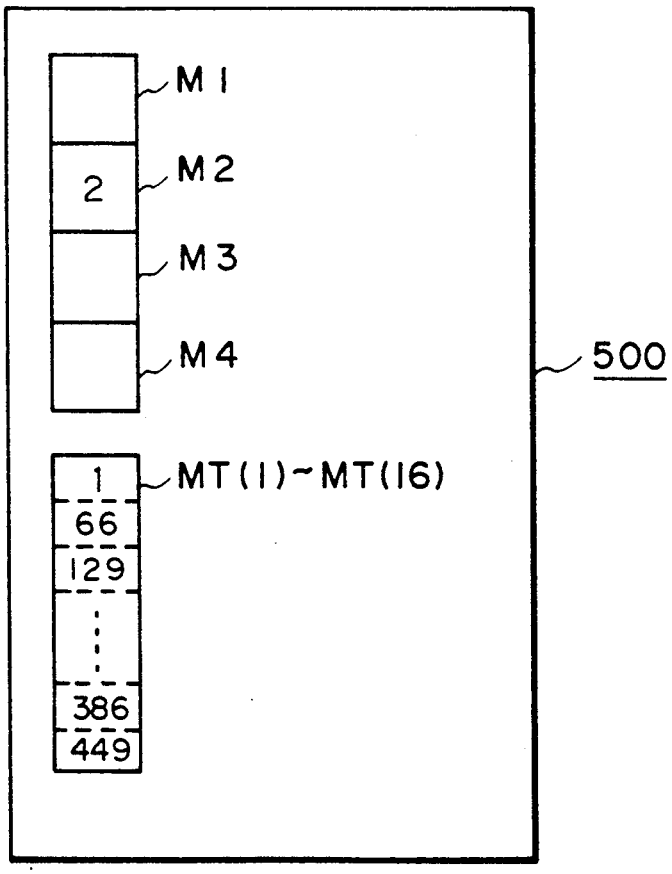
FIG. 5 is a conceptual view of memories used in the invention.

For accomplishing the above method, a memory 500 as shown in FIG. 5 is provided in the scanning signal control circuit 104. Referring FIG. 5, the memory 500 includes a scanning address memory M1, an address increment memory M2, a line-number counter memory M3, a block-number counter memory, and address table memories $MT_{(1)}$-$MT_{(16)}$. As fixed values, the number of 2 is set at the address increment memory M2, and the 16 numbers of 1, 66, 129, 194, 257, 322, 385, 450, 2, 65, 130, 193, 258, 321, 386 and 449 are set at the address table memories $MT_{(1)}$-$MT_{(16)}$, respectively, as the starting scanning address (positional ranks of the starting scanning electrodes) among the entire scanning electrodes for the first vertical scanning and the second vertical scanning in that order. Here, the content of the scanning address memory means the scanning address. The content of the address increment memory M2 means the number of scanning electrodes covered by one-time of scanning (namely "2" means that every other line is scanned). The content of the line-number counter memory means the number of times of scanning effected at that time in each block. The content of the block-number counter memory M4 means the number of block for which the scanning is performed at that time throughout the first vertical scanning and second vertical scanning. The contents of the address table memories $MT_{(1)}$-$MT_{(16)}$ mean the scanning addresses from which the scanning is started for the respective blocks.

Figure 6:
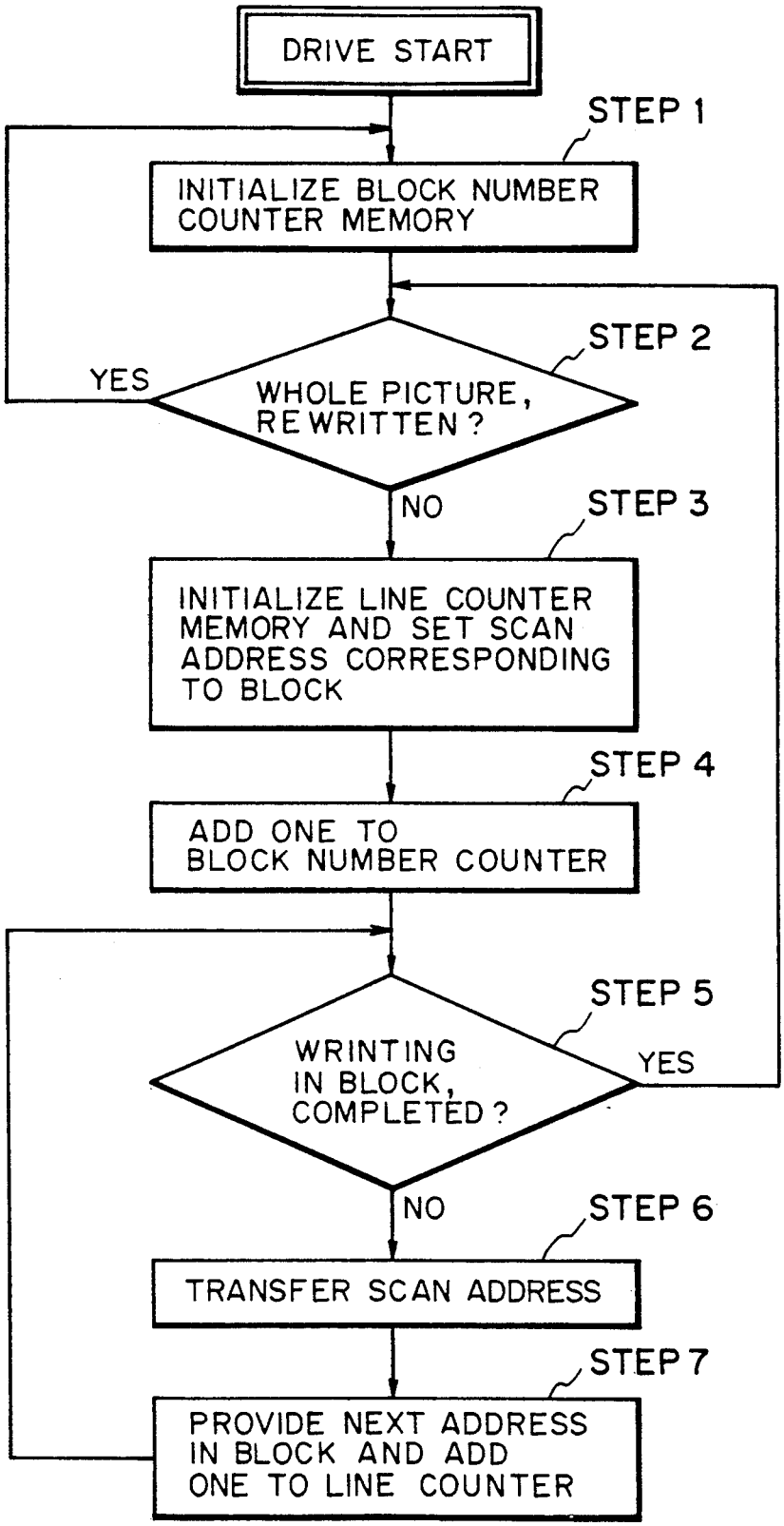
FIG. 6 is a block diagram showing an algorithm used in the invention.

FIG. 6 shows an algorithm for determining the scanning addresses. At Step 1, the number of "1" is set in the block-number counter memory M4 for initialization. At Step 2, the number in the block-number counter memory M4 is checked as the whether it reaches 16 (M4>16) in order to judge whether all the blocks have been written. At Step 3, the line-number counter memory is initialized for scanning in each block. First of all, a number of "1" is set in the line-number counter memory M3 for first scanning in the block. Then so as to determine the starting scanning address in the block concerned, the number of the block is checked according to the content of the block-number counter memory, and the starting scanning address in the block is checked according to the content of the corresponding address table memory MT to set the starting scanning address at the scanning address memory M1. At Step 4, a number "1" is added to the block-number counter memory M4. At Step 5, it is checked whether the content of the line-number counter memory M3 reaches 32 (M3>32) so as to judge whether the writing in the block has been completed. At Step 6, the scanning address is transferred. At Step 7, the content of the address increment memory M2 is added to the content of the scanning address memory M1, and a number of "1" is added to the line-number counter memory M3.

Thus, according to the algorithm shown in FIG. 6, the content of the address table memory MT is set to the scanning address memory M1 based on the content of the block-number counter memory M4, and this operation is repeated 16 times, during each of which the steps of sending the scanning address to the scanning signal application circuit and increasing the content of the scanning line address memory by "2" (the content of the address increment memory M2) are repeated 32 times. After the scanning address is transferred 16×32 times, the operation is restored to the beginning. Before the first transfer of scanning address, a number of "1" is set at each of the scanning address memory M1, the line-number counter memory M3 and the block-number counter memory M4.

Now, if an image as shown in FIG. 2 is taken for example, wherein the pixels on the odd-numbered scanning electrodes, i.e., 1st, 3rd, 5th . . . to 511th lines, are in black, and the pixels on the even-numbered scanning electrodes, i.e., 2nd, 4th, 6th . . . to 512th lines alternately assume black, white, black, white, . . . , a pixel P22 repetitively receives black signal and white signal for each 32 lines. The frequency of repetition is 1/(32×2×96 μsec)=163 Hz (>40 Hz), so that no flickering occurs.

On the other hand, if a similar image is displayed according to the conventional 2-interlaced scanning scheme, the 1st, 3rd, 5th . . . to 511th lines are sequentially selected to complete the first vertical scanning, and subsequently the 2nd, 4th, . . . to 512th lines are sequentially selected to complete the second vertical scanning, whereby one whole picture is written. In this case, the pixel P22 continuously receives the black signal 256 times and then continuously receives the white signal 256 times, so that the signal repetition frequency becomes 1/(256×2×96 μsec)=20.3 Hz (<40 Hz), whereby flickering is observed.

Further, if the 8-interlaced scanning scheme is adopted so as to obviate flickering, while the flickering is removed due to an increased frequency, the observability of a motion picture is remarkably impaired because a picture is constituted by one time of scanning for 8 lines in comparison with one time of scanning for 2 lines.

Second Embodiment

In this embodiment, a liquid crystal display apparatus is constituted by 1024 scanning electrodes and 1280 data electrodes disposed to form an electrode matrix.

When the selectively term for one scanning electrode is 96 μsec, the frame frequency becomes 1/(1024×96 μsec)=10.2 Hz. So as to provide a field frequency of 40 Hz or higher, a whole picture is designed to be formed by four times of vertical scanning.

Figure 7:
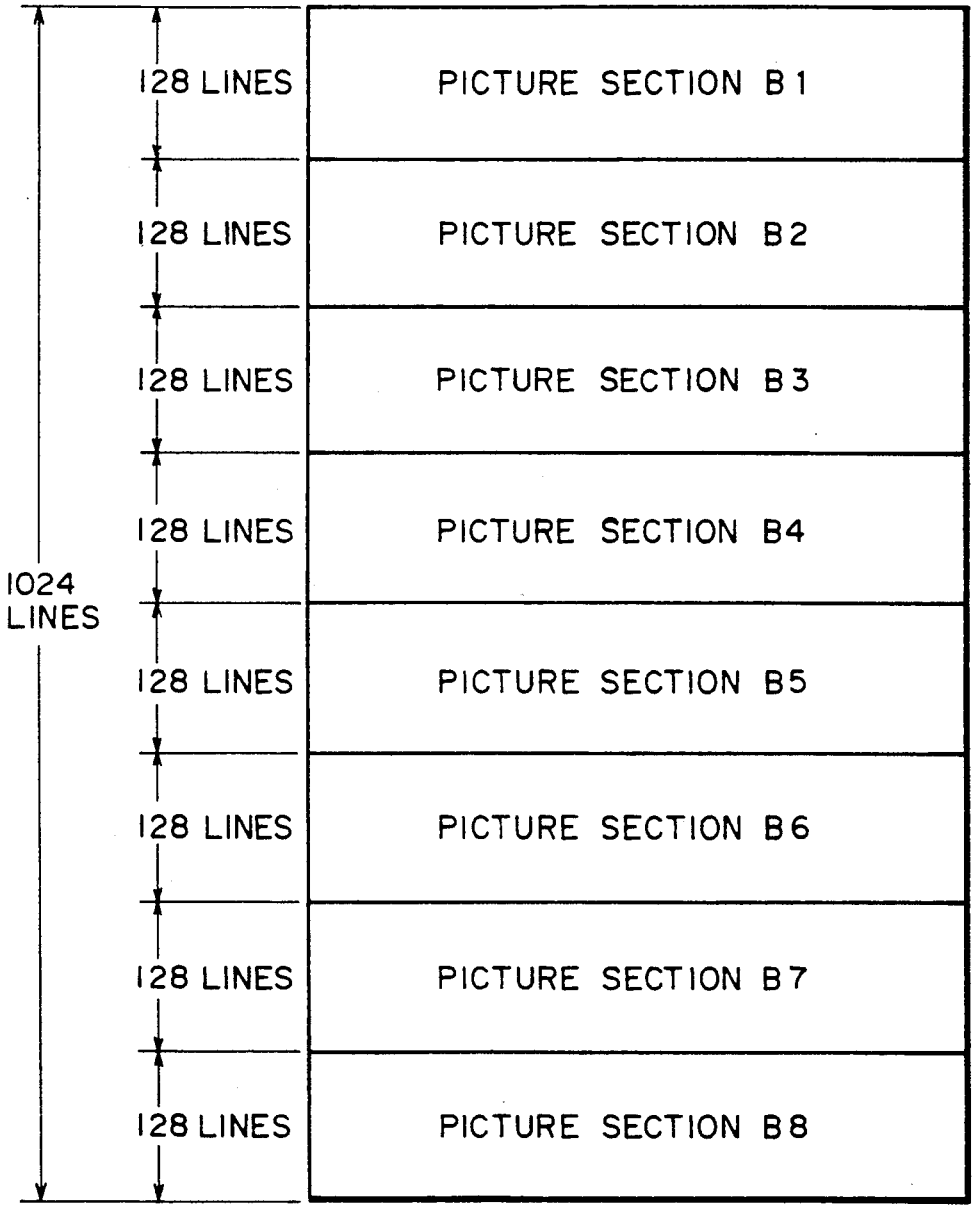
FIG. 7 is a schematic view of another picture area divided into blocks.

As shown in FIG. 7, the whole picture area composed of 1024 lines (scanning electrodes) is divided into 8 picture sections ("block(s)") B1–B8 each comprising 128 scanning electrodes. In the first block B1, every fourth scanning electrode is selected from the first scanning electrode as a starting scanning electrode so that the 1st, 5th, 9th, . . . to 123th scanning electrodes are sequentially selected. In the second block B2, every fourth scanning electrode is selected from the second scanning electrode as a starting scanning electrode so that the 2nd, 6th, 10th . . . to 126th scanning electrodes (130th, 134th, 138th, . . . to 254th scanning electrodes in the entire scanning electrodes) are sequentially selected. Similarly, as for the third block, the 3rd (starting), 7th, 11th . . . to 127th scanning electrodes are sequentially selected, and as for the fourth block, the 4th (starting), 8th, 12th . . . to 128th scanning electrodes are sequentially selected. Further, as for 5th, 6th, 7th and 8th blocks, only (4n−3)th, (4n−2)th, (4n−1)th and 4n-th electrodes (n=1, 2, . . . , 32), respectively are sequentially selected to complete the first vertical scanning.

In a subsequent field scanning, in the first block, the 2nd (starting), 6th, 10th . . . to 126th scanning electrodes are sequentially selected. In the 2nd, 3rd, 4th, 5th, 7th and 8th blocks, only the (4n−1)th, 4n-th, (4n−3)th, (4n−2)th, (4n−1)th, 4n-th and (4n−3)th scanning electrodes (n=1, 2, 3, . . . , 32), respectively, are sequentially selected to complete the second vertical scanning.

In a subsequent field scanning, only the (4n−1)th, 4n-th, (4n−3)th, (4n−2)th, (4n−1)th, 4n-th, (4n−3)th and (4n−2)th scanning electrodes (n=1, 2, 3, . . . , 32) are sequentially selected in the 1st, 2nd, 3rd, 4th, 5th, 6th, 7th and 8th blocks, respectively, to complete the third vertical scanning. In a subsequent field scanning, only the 4n-th, (4n−3)th, (4n−2)th, (4n−1)th, 4n-th, (4n−3)th, (4n−2)th and (4n−1)th scanning electrodes (n=1, 2, 3, . . . ) are sequentially selected in the 1st, 2nd, 3rd, 4th, 5th, 6th, 7th and 8th blocks, respectively, to complete the fourth vertical scanning, whereby a whole picture is written.

Figure 8:
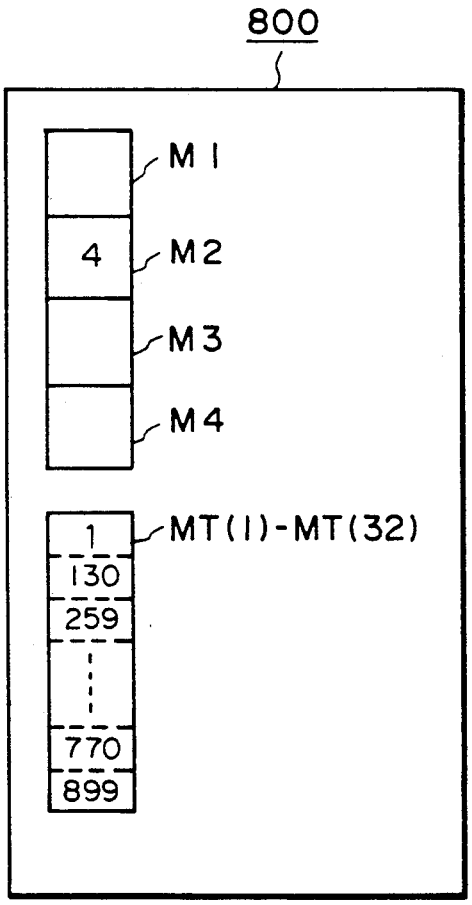
FIG. 8 is a conceptual view of another set of memories.

For accomplishing the above method, a memory 800 as shown in FIG. 8 is provided in the scanning signal control circuit 104. As fixed values, the number of 4 is set at the address increment memory M2, and the 32 numbers of 1, 130, 259, 388, 513, 642, 771, 900, 2, 131, 260, 385, 514, 643, 772, 897, 3, 132, 257, 386, 515, 644, 769, 898, 4, 129, 258, 387, 516, 641, 770 and 899 are set at the address table memories $MT_{(1)}$-$MT_{(32)}$, respectively, as the starting scanning address (positional ranks of the starting scanning electrodes) among the entire scanning electrodes for the first, second, third and fourth vertical scanning in that order.

Scanning addresses are determined according to an algorithm similar to the one shown in FIG. 6 except that it is checked whether the content of the block number counter reaches 32 (M4≧32) at Step 2.

Now, if an image as shown in FIG. 2 is taken for example, wherein the pixels on the odd-numbered scanning electrodes, i.e., 1st, 3rd, 5th . . . to 1023th lines, are in black, and the pixels on the even-numbered scanning electrodes, i.e., 2nd, 4th, 6th . . . to 1024th lines alternately assume black, white, black, white, . . . , a pixel P22 repetitively receives black signal and white signal for each 32 lines. The frequency of repetition is 1/(32×2×96 μsec)=163 Hz (>40 Hz), so that no flickering occurs.

On the other hand, if a similar image is displayed according to the conventional 4-interlaced scanning scheme, the 1st, 5th, 9th . . . to 1021th lines are sequentially selected to complete the first vertical scanning, then the 2nd, 6th, 10th, . . . to 1022th lines are sequentially selected to complete the second vertical scanning, the 3rd, 7th, 11th, . . . to 1023th lines are sequentially selected to complete the third vertical scanning, and the 4th, 8th, 12th, . . . to 1024th lines are sequentially selected to complete the fourth vertical scanning, whereby one whole picture is written. In this case, the pixel P22 receives the black signal and white signal alternating after continuation of 256 times each, so that the signal repetition frequency becomes 1/(256×2×96 μsec)=20.3 Hz (<40 Hz), whereby flickering is observed.

Further, if the 16-interlaced scanning scheme is adopted so as to obviate flickering, while the flickering is removed due to an increased frequency, the observability of a motion picture is remarkably impaired because a picture is constituted by one time of scanning for 16 lines each in comparison with one time of scanning for 4 lines each.

The above-mentioned First Embodiment is summarized in the following Tables 1 and 2, and Second Embodiment is summarized in Tables 3 and 4, respectively, together with their performances in comparison with conventional interlaced scanning schemes.

TABLE 1

| Block No. | Positional ranks of scanning electrodes constituting the block in all the scanning electrodes in the whole picture area | Positional ranks of scanning electrodes in the block selected in the indicated field: 1st field | 2nd field |
|---|---|---|---|
| Block B1 | 1 to 64-th | (2n-1)th | 2n-th |
| Block B2 | 65 to 128-th | 2n-th | (2n-1)th |
| Block B3 | 129 to 192-th | (2n-1)th | 2n-th |
| Block B4 | 193 to 256-th | 2n-th | (2n-1)th |
| Block B5 | 257 to 320-th | (2n-1)th | 2n-th |
| Block B6 | 321 to 384-th | 2n-th | (2n-1)th |
| Block B7 | 385 to 448-th | (2n-1)th | 2n-th |
| Block B8 | 449 to 512-th | 2n-th | (2n-1)th |

(n = 1, 2, 3, 4, . . ., 32)

TABLE 2

| | 2-interlace | 8-interlace | First embodiment |
|---|---|---|---|
| Flicker due to scanning drive | None | None | None |
| Flicker due to repetition of black and white signals | Observed | None | None |
| Observability of motion picture | Good | Poor | Good |

TABLE 3

| Block No. | Positional ranks of scanning electrodes constituting the block in all the scanning electrodes in the whole picture area | Positional ranks of scanning electrodes in the block selected in the indicated field | | | |
|---|---|---|---|---|---|
| | | 1st field | 2nd field | 3rd field | 4th field |
| Block B1 | 1 to 128-th | (4n-3)th | (4n-2)th | (4n-1)th | 4n-th |
| Block B2 | 129 to 256-th | (4n-2)th | (4n-1)th | 4n-th | (4n-3)th |
| Block B3 | 257 to 384-th | (4n-1)th | 4n-th | (4n-3)th | (4n-2)th |
| Block B4 | 385 to 512-th | 4n-th | (4n-3)th | (4n-2)th | (4n-1)th |
| Block B5 | 513 to 640-th | (4n-3)th | (4n-2)th | (4n-1)th | 4n-th |
| Block B6 | 641 to 768-th | (4n-2)th | (4n-1)th | 4n-th | (4n-3)th |
| Block B7 | 769 to 896-th | (4n-1)th | 4n-th | (4n-3)th | (4n-2)th |
| Block B8 | 897 to 1024-th | 4n-th | (4n-3)th | (4n-2)th | (4n-1)th |

(n = 1, 2, 3, 4, . . ., 32)

TABLE 4

| | 4-interlace | 16-interlace | Second embodiment |
|---|---|---|---|
| Flicker due to scanning drive | None | None | None |
| Flicker due to repetition of black and white signals | Observed | None | None |
| Observability of motion picture | Good | Poor | Good |

Figure 9:
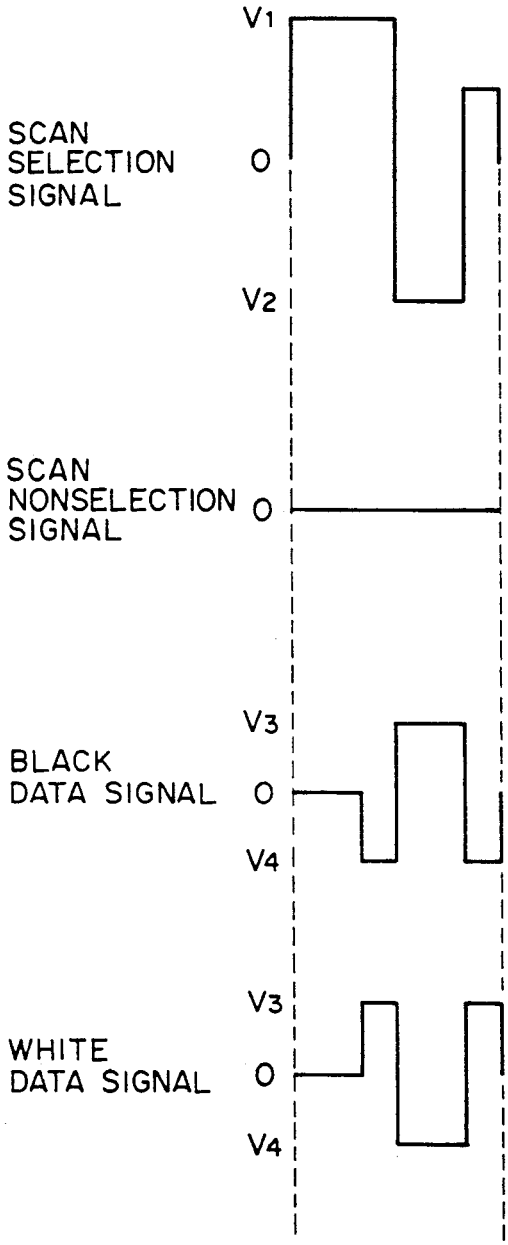
FIG. 9 shows a set of drive signal waveforms used in the drive system of the present invention.
Figure 10:
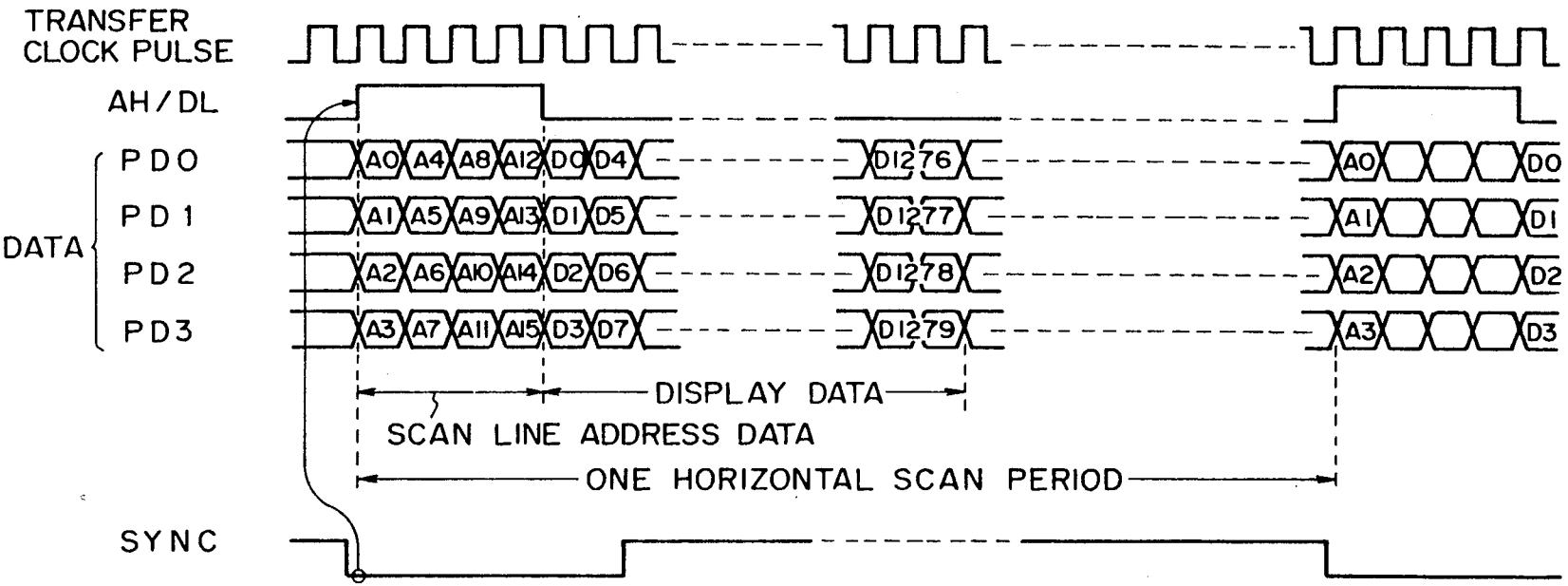
FIG. 10 is a time chart showing time correlation between signal transfer and driving.

FIG. 9 shows a set of drive signal waveforms used in evaluation of the above embodiments and FIG. 10 is a time chart showing correlation between signal transfer and driving.

The above-described liquid crystal device unit may also be applicable to an image recording apparatus instead of an image display apparatus as described above.

Figure 11:
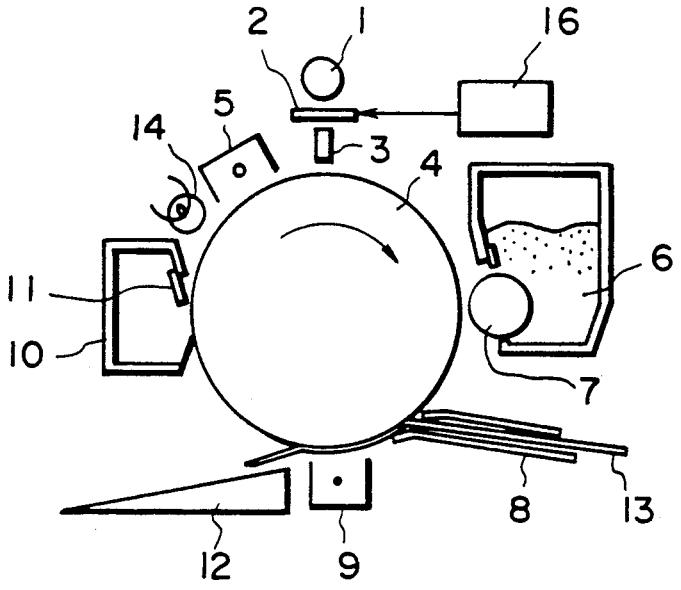
FIG. 11 is a schematic illustration of an image recording apparatus using a liquid crystal device of the invention.
Figure 12:
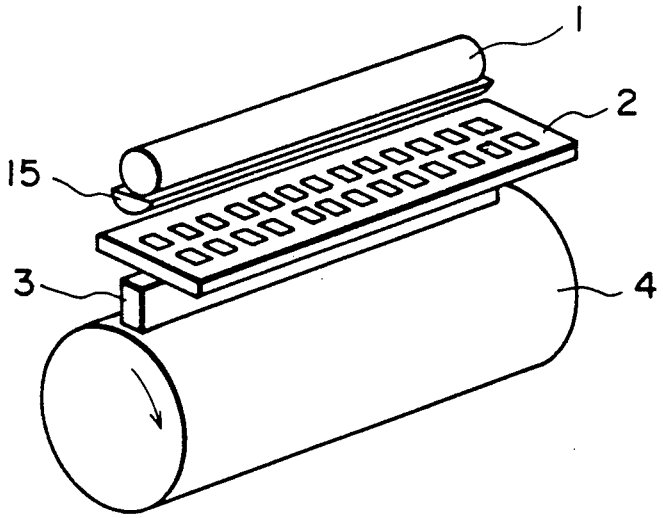
FIG. 12 is a perspective view showing essential parts of the image recording apparatus.

FIG. 11 illustrates an electrophotographic image recording apparatus in which the above-mentioned liquid crystal device unit is used as a liquid crystal shutter for modulating and controlling light-exposure of a photosensitive member. Referring to FIG. 11, the image recording apparatus includes an exposure lamp 1 as a light source, a liquid crystal shutter 2 (including two polarizers not specifically shown) driven by a driver 16, an array of short-focus image formation elements 3, a photosensitive drum 4, an electric charger 5, a developing device 6, a developing sleeve 7, a transfer guide 8, a transfer charger 9, a cleaning device 10, a cleaning blade 11, and a conveyer guide 12. In operation, the photosensitive drum 4 rotating is the direction of an arrow as shown in charged by means of an electric charger 5 and then exposed to modulated light depending on image signals to form an electrostatic latent image. Optical modulation for producing the modulated light is performed, as shown in FIG. 12, by transmitting or interrupting light from the exposure lamp 1 by means of the liquid crystal shutter array 2 arranged in parallel with the axis of the photosensitive drum 4. In the liquid crystal shutter array, a large number of liquid crystal shutter elements (pixels) are arranged in a staggered fashion so as to increase the arrangement density of the shutter elements. A rod lens 15 may be used as desired for condensing the light from the exposure lamp 1 onto the liquid crystal shutter array 2.

The thus formed electrostatic latent image is developed by attachment of a charged toner on the developing sleeve 7. The toner image thus formed on the photosensitive drum 4 is transferred to a transfer paper 13 supplied from a paper-supplying cassette (not shown) under discharge from the backside of the transfer paper 13 by the transfer charger 9, and the transferred toner image on the transfer paper 13 is conveyed by the conveyer means 12 to a fixing device (not shown) and fixed thereat onto the transfer paper 13. On the other hand, a portion of the toner remaining on the photosensitive drum 4 without being transferred is scraped off the drum surface by the cleaning blade 11 to be recovered in the cleaning device 10. The charge remaining on the photosensitive drum is extinguished by illumination from a pre-exposure lamp 14.

What is claimed is:

1. A display apparatus, comprising:

(a) an electrode matrix comprising a group of scanning electrodes and a group of data electrodes;

(b) drive means including first means for applying a scanning signal to said scanning electrodes and second means for applying data signals to said data electrodes in synchronism with said scanning signal; and (c) control means for controlling said drive means so as to divide said scanning electrodes into a plurality of blocks each comprising a plurality of scanning electrodes and select said scanning electrodes with skipping of at least one scanning electrode apart so that starting scanning electrodes in neighboring blocks from which the skipping-selection of scanning electrodes is started in each block of said scanning electrodes have mutually different positional ranks respectively in said neighboring blocks.

2. A display apparatus according to claim 1, wherein a liquid crystal is disposed between said scanning electrodes and said data electrodes.

3. A display apparatus according to claim 2, wherein said liquid crystal is a ferroelectric liquid crystal.

4. A display apparatus, comprising:

(a) an electrode matrix having a picture area with scanning lines and comprising a group of scanning electrodes and a group of data electrodes;

(b) drive means including first drive means for applying a scanning selection signal to said scanning electrodes and second drive means for applying data signals to said data electrodes; and (c) control means for controlling said first drive means so as to divide said picture area into a plurality of picture sections in a scanning direction, each picture section comprising a plurality of scanning electrodes, sequentially scan-selecting a picture section and applying a scanning selection signal to said scanning electrodes in a selected picture section with skipping of a prescribed number of at least one scanning electrode apart from a starting scanning electrode in said selected picture section which has a positional rank in a certain picture section so that a starting scanning electrode from which the scanning is started in a selected certain picture section which is different from that of a starting scanning electrode in a subsequently selected picture section from which the scanning is started in the subsequently selected picture section in one vertical scanning operation, effecting a plurality of vertical scanning operations to form a whole picture, and controlling said second drive means so as to apply data signals to said data electrodes in synchronism with said scanning selection signal.

5. A display apparatus according to claim 4, wherein said starting scanning electrode in said subsequently selected picture section has a positional rank differing by +1 from that of said starting scanning electrode in said certain picture section.

6. A display apparatus according to claim 4, wherein said starting scanning electrode in said subsequently selected picture section has a positional rank differing by −1 from that of said starting scanning electrode in said certain picture section.

7. A display apparatus according to claim 4, wherein said starting scanning electrode in said subsequently selected picture section has a positional rank differing by an odd number from that of said starting scanning electrode in said certain picture section.

8. A display apparatus according to claim 4, wherein said respective picture sections have said same size.

9. A display apparatus according to claim 4, wherein the picture sections are present in a total number of $2^n$, wherein n is a natural number and $2^n <$ the total number of scanning lines.

10. A display apparatus according to claim 4, wherein said scanning selection signal is applied to an every 2n-th scanning electrode, with n = a natural number and $2^n <$ the number of scanning lines in an associated picture section.

11. A display apparatus according to claim 4, wherein a liquid crystal is disposed between said scanning electrodes and said data electrodes.

12. A display apparatus according to claim 11, wherein said liquid crystal is a ferroelectric liquid crystal.

13. A display apparatus according to claim 4, wherein said starting scanning electrode in said certain picture section is an n-th scanning electrode in said picture section and said starting scanning electrode in said subsequently selected picture section is an n+1-th scanning electrode in said subsequently selected picture section, wherein n is a natural number.

14. A display apparatus according to claim 4, wherein said starting scanning electrode in said certain picture section is a 2n-th scanning electrode in said picture section and said starting scanning electrode in said subsequently selected picture section is a (2n−1)th scanning electrode in said subsequently selected picture section, wherein n is a natural number.

15. A display apparatus according to claim 4, wherein said starting scanning electrode in said certain picture section is an n-th scanning electrode in the picture section and said starting scanning electrode in said subsequently selected picture section is an n+m-th scanning electrode in said subsequently selected picture section, wherein n is natural number and m is a positive odd number.

16. A display system, comprising:

(a) an electrode matrix comprising a group of scanning electrodes and a group of data electrodes;

(b) drive means including first means for applying a scanning signal to said scanning electrodes and second means for applying data signals to said data electrodes in synchronism with said scanning signal;

(c) control means for controlling said drive means so as to divide said scanning electrodes into a plurality of blocks each comprising a plurality of scanning electrodes and select said scanning electrodes with skipping of at least one scanning electrode apart so that starting scanning electrodes in neighboring blocks from which the skipping-selection of scanning electrodes is started in each block of said scanning electrodes have mutually different positional ranks respectively in said neighboring blocks; and (d) image data control means for supplying data to said control means corresponding to given image data.

17. A display system, comprising:

(a) an electrode matrix having a picture area and comprising a group of scanning electrodes and a group of data electrodes;

(b) drive means including first drive means for applying a scanning selection signal to said scanning electrodes and second drive means for applying data signals to said data electrodes; and (c) control means for controlling said first drive means so as to divide said picture area into a plurality of picture sections in a scanning direction, each picture section comprising a plurality of scanning electrodes, sequentially scan-selecting a picture section and applying a scanning selection signal to said scanning electrodes in a selected picture section with skipping of a prescribed number of at least one scanning electrode apart from a starting scanning electrode in said selected picture section so that a starting scanning electrode from which the scanning is started in a selected certain picture section has a positional rank in said certain picture section which is different from that of a starting scanning electrode in a subsequently selected picture section from which the scanning is started in said subsequently selected picture section in one vertical scanning operation, effecting a plurality of vertical scanning operations to form a whole picture, and controlling said second drive means so as to apply data signals to said data electrodes in synchronism with said scanning selection signal; and (d) image data control means for supplying data to said control means corresponding to given image data.

18. A recording apparatus, comprising:

(a) an electrode matrix comprising a group of scanning electrodes and a group of data electrodes;

(b) drive means including first means for applying a scanning signal to said scanning electrodes and second means for applying data signals to said data electrodes in synchronism with said scanning signal;

(c) control means for controlling said drive means so as to divide said scanning electrodes into a plurality of blocks each comprising a plurality of scanning electrodes and select said scanning electrodes with skipping of at least one scanning electrode apart so that starting scanning electrodes in neighboring blocks from which the skipping-selection of scanning electrodes is started in each block of said scanning electrodes have mutually different positional ranks respectively in said neighboring blocks;

(d) image data control means for supplying data to said control means corresponding to given image data;

(e) a photosensitive member; and (f) a developing device.

19. A recording apparatus, comprising:

(a) an electrode matrix having a picture area and comprising a group of scanning electrodes and a group of data electrodes;

(b) drive means including first drive means for applying a scanning selection signal to said scanning electrodes and second drive means for applying data signals to said data electrodes;

(c) control means for controlling said first drive means so as to divide said picture area into a plurality of picture sections in a scanning direction, each picture section comprising a plurality of scanning electrodes, sequentially scan-selecting a picture section and applying a scanning selection signal to said scanning electrodes in a selected picture section with skipping of a prescribed number of at least one scanning electrode apart from a starting scanning electrode in said selected picture section so that a starting scanning electrode from which the scanning is started in a selected certain picture section has a positional rank in said certain picture section which is different from that of a starting scanning electrode in a subsequently selected picture section from which the scanning is started in said subsequently selected picture section in one vertical scanning operation, effecting a plurality of vertical scanning operations to form a whole picture, and controlling said second drive means so as to apply data signals to said data electrodes in synchronism with said scanning selection signal;

(d) image data control means for supplying data to said control means corresponding to given image data;

(e) a photosensitive member; and (f) a developing state.

* * * * *

UNITED STATES PATENT AND TRADEMARK OFFICE

CERTIFICATE OF CORRECTION

PATENT NO. : 5,172,105

DATED : December 15, 1992

INVENTOR(S) : Kazunori Katakura, et al.

It is certified that error appears in the above-indentified patent and that said Letters Patent is hereby corrected as shown below:

On the title page,

[56] REFERENCES CITED:

U.S. PATENT DOCUMENTS, insert --4,838,652 6/1989 Inaba, et al. 350/331R--.

FOREIGN PATENT DOCUMENTS, insert --2159656 12/1985 United Kingdom-- and --2580826 10/1986 France--.

OTHER PUBLICATIONS, insert --"Kotai Butsuri" (Solid State Physics), Vol. 16, No. 3, pp. 141-151 (1981).--.

SHEET 4:

FIG. 6, "WRINTING" should read --WRITING--.

COLUMN 3:

Line 40, "C-C6" should read --C1-C6--.

COLUMN 4:

Line 56, "<36" should read --#36--.

COLUMN 5:

Line 29, "2n-th" (last occurrence) should be deleted.

COLUMN 6:

Line 7, "the" should read --to--.

UNITED STATES PATENT AND TRADEMARK OFFICE

CERTIFICATE OF CORRECTION

PATENT NO. : 5,172,105

DATED : December 15, 1992

INVENTOR(S) : Kazunori Katakura, et al.

It is certified that error appears in the above-indentified patent and that said Letters Patent is hereby corrected as shown below:

Line 8, "(M4>16) should read --(M4≧16)--.
Line 23, "(M3>32) should read --(M3≧32)--.

COLUMN 7:

Line 10, "selectively" should read --selecting--.

COLUMN 9:

Line 45, "is" should read --in--.
Line 46, "in" should read --is--.

COLUMN 11:

Line 33, "2n-th" should read --$2^n$-th--.
Line 51, "2n-th" should read --$2^n$-th--.

UNITED STATES PATENT AND TRADEMARK OFFICE

CERTIFICATE OF CORRECTION

PATENT NO. : 5,172,105

DATED : December 15, 1992

INVENTOR(S) : Kazunori Katakura, et al

It is certified that error appears in the above-indentified patent and that said Letters Patent is hereby corrected as shown below:

COLUMN 14:

Line 20, "state" should read --device--.

Signed and Sealed this

Eighth Day of February, 1994

Bruce Lehman

*Attest:*

BRUCE LEHMAN

*Attesting Officer*

*Commissioner of Patents and Trademarks*